United States Patent [19]

Clark

[11] Patent Number: 5,029,798

[45] Date of Patent: Jul. 9, 1991

[54] BOOK HOLDER DEVICE

[76] Inventor: Thomas A. Clark, 20 Plum Tree La., 16H, Midvale, Utah 84047

[21] Appl. No.: 494,772

[22] Filed: Mar. 16, 1990

[51] Int. Cl.[5] ..... A47B 97/04

[52] U.S. Cl. ..... 248/459; 206/45.24; 206/45.25; 248/174

[58] Field of Search ..... 248/459, 460, 455, 174; 206/45.24, 45.25; 40/124, 124.1

[56] References Cited

U.S. PATENT DOCUMENTS

| | | | |
|---|---|---|---|
| 1,435,658 | 11/1922 | Prehn | 248/459 |
| 3,410,516 | 11/1968 | Criswell | 248/459 |
| 3,447,770 | 6/1969 | Gallamos | 248/459 X |
| 3,758,065 | 9/1973 | Ranseen | 248/459 |
| 3,762,675 | 10/1973 | Sankey . | |
| 3,785,605 | 1/1974 | Hemant Parckh . | |
| 3,813,074 | 5/1974 | Mulvaney . | |
| 3,813,075 | 5/1974 | Capper . | |
| 3,897,037 | 1/1974 | Johnson . | |
| 3,937,435 | 2/1976 | Roberts . | |
| 3,952,989 | 4/1976 | Bannister . | |
| 4,022,418 | 5/1910 | Kellner . | |
| 4,036,465 | 7/1977 | Kellner . | |
| 4,064,580 | 12/1977 | Ezekoye . | |
| 4,105,182 | 8/1978 | Jacobson . | |
| 4,116,414 | 9/1978 | Robertson . | |
| 4,119,289 | 10/1978 | Kanocz . | |
| 4,150,807 | 4/1979 | Manso . | |
| 4,274,616 | 6/1981 | Redtke . | |
| 4,295,624 | 10/1981 | Granada . | |
| 4,296,946 | 10/1981 | Larre et al. . | |
| 4,318,527 | 3/1982 | Smith . | |
| 4,323,214 | 4/1982 | Deluca . | |
| 4,436,271 | 3/1984 | Manso . | |
| 4,460,146 | 7/1984 | Raggiotti . | |
| 4,466,593 | 9/1984 | Odenath . | |
| 4,522,364 | 6/1985 | Charney et al. . | |
| 4,588,074 | 5/1986 | Strong et al. . | |
| 4,610,416 | 9/1986 | Choi . | |
| 4,674,724 | 6/1987 | Gaudet . | |
| 4,722,504 | 2/1988 | Degenholtz | 248/459 |

*Primary Examiner*—Ramon O. Ramirez
*Attorney, Agent, or Firm*—Trask, Britt & Rossa

[57] ABSTRACT

A portable book stand fabricated from a planar panel of substantially rigid material is disclosed. The book stand includes a book support surface, a shelf extending outwardly from that support surface and a plurality of tab-like support members which function as supports for the shelf and the support surface. Each of the supports are in turn supported by auxiliary tab-like supports which retain them in position.

19 Claims, 6 Drawing Sheets

BOOK HOLDER DEVICE

BACKGROUND OF THE INVENTION

1. Field

This invention relates to portable book stands adapted to retain a book or other reading or visual material in an open position before a reader or viewer. More particularly, this invention is directed to a book stand which is portable.

2. Statement of the Art

Book stands of various configurations are known in the art. In general, these book stands have a common characteristic of being able to support a book in an open configuration whereby the reader may read the book without having to hold the book in his hands. This hands-free operation may be solely for the purposes of reading comfort. Alternatively, the capacity to maintain the book in an open configuration, without involvement of the user's hands, may be a desirable feature should the user be engaged in some type of activity at the time of reading the book that requires the use of his hands, e.g. the assembly of a device or structure based on instructions contained in the book.

While book stands have been known for many years, recent efforts in the art have been directed towards providing book stands which are structurally strong enough to support a book, yet sufficiently lightweight to permit the user to readily pick up the book stand and relocate it to an alternate location. Many of these book stands have incorporated novel-type structures which support or stabilize the book stand on a support surface. Other structures have been suggested which are directed towards providing an adjustable means of holding books of various widths and configurations.

A representative book stand which has been suggested in the art is that disclosed in U.S. Pat. No. 4,022,418 (Kellner). The Kellner device discloses a generally "U"-shaped, uprightly mounted panel having a support brace hingedly mounted on its rear surface. The support brace extends outwardly in an angulated fashion from the upright panel to contact the ground and form a support to hold the "U"-shaped panel in position. A laterally extending shelf is mounted, by means of brackets, on the front surface of the "U"-shaped panel. The shelf is adapted to support a book positioned thereon and defines therein a plurality of interconnected channels. A pair of peg type members is slidably mounted within those channels to be positioned in a variety of locations on the shelf. Each peg is of sufficient height to engage against one side of an open book, positioned on the shelf, and retain that book in abutment against the "U"-shaped upright panel. Owing to the ability to reposition the peg in the channels, the user may reorient the peg to hold books of various widths.

Another book shelf configuration is shown in U.S. Pat. No. 4,274,616 (Radtke). This patent illustrates a book stand having a support surface which is supported at an acute angle to an underlying support surface by means of an uprightly mounted support which is conjoined at its lower end to a laterally extending support. Each of these two supports are connected to an angulated book supporting surface along their respective edges to form a generally triangular cross sectioned structure. A support shelf mounted at a generally orthogonal orientation to the angulated book support surface is fixedly mounted to the support surface proximate its lowermost end. The support shelf forms a means of supporting and retaining the book on the angulated support surface.

In U.S. Pat. No. 4,285,624 (Granada), a planar book support surface having a support shelf is adapted to be supported above an underlying surface by a laterally extending member which is hingedly mounted to the rear surface of the book support surface. The extending member is adapted to be adjustable in length, whereby the user may adjust the orientation, i.e. the angle of the planar surface to the underlying surface by adjusting the length of the extending member. The extending member includes a ratchet-type adjustment structure wherein a first member of the extending member is slidably received within a sheath-like second member. The first member defines a plurality of teeth along one edge thereof. The sheath member includes a ratchet type lever which is adapted to be manually intercooperated with the teeth of the first member whereby the user may adjust the positioning of the sheath over and about the first member by engaging the ratchet lever between a pair of selected teeth thereby locking the sheath in a fixed relationship with the first member and hence adjusting the orientation of the planar support surface on an underlying surface such as a floor or table top.

In U.S. Pat. No. 4,466,593 (Odenath), a book support includes a generally planar support surface having a laterally extending shelf, apparently fixedly mounted thereon to extend orthogonally outward. A pair of outwardly extending supports are mounted on the rear surface of the planar book support surface by means of a pair of channel supports which extend longitudinally along the length of the planar book support surface. Two generally planar panels, one panel positioned within the open channel of a respective support extending outwardly from the planar book support surface, are engaged and supported within a respective support bracket adapted to engage an underlying surface such as a table top.

Of the many types of book stands which have been disclosed in the art, some attempts have been made to provide a book stand which is not only portable, but furthermore is also foldable whereby the user may, after having used the book stand, be able to fold the book stand into a rather compact structure which may be more suited for storage. A book holder having this directed purposed is disclosed in U.S. Pat. No. 4,610,416 (Choi). In this particular construction a generally quadrilateral planar support surface is folded proximate its one end to form an outwardly extending shelf. An auxiliary support member is fixedly mounted on that shelf to extend downwardly from the extended shelf to engage the underlying support surface. A pair of laterally extending wings are mounted on the rear surface of the planar book support surface to extend outwardly therefrom and engage an underlying surface. Each of the wings defines a slot therein which is configured to receive a respective tab of a laterally extending planar member which is adapted to extend between the two wings and hold the wings in a preselected orientation vis-a-vis each other and the planar book support surface.

Another portable book stand is disclosed in U.S. Pat. No. 4,460,146 (Raggiotti). In this particular construction a planar piece of stock is cut and creased into three portions which can be either folded flat or assembled into a three-dimensional configuration adapted to support a reading book.

A similar collapsible book stand is shown in U.S. Pat. No. 4,674,724 (Gauget). In this particular construction a generally flat planar panel is cut and creased along a plurality of selected portions thereof to provide a collapsible stand adapted for supporting books or other reading material.

While the aforementioned descriptions illustrate a number of previously disclosed book stands it should be recognized that considerable attention has been directed in this particular art to devising and suggesting various alternative book stand configurations. Other book stand type structures which may also be illustrative of efforts in this particular area include the following: U.S. Pat. No. 4,436,271 (Nanso); U.S. Pat. No. 4,323,214 (DeLuca); U.S. Pat. No. 4,150,807 (Manso); U.S. Pat. No. 4,116,414 (Robertson); U.S. Pat. No. 4,296,946 (Larre et al.); U.S. Pat. No. 4,318,527 (Smith); U.S. Pat. No. 4,119,289 (Kanocz); U.S Pat. No. 4,105,182 (Jacobson); U.S. Pat. No. 4,522,364 (Charney et al.); U.S. Pat. No. 3,785,605 (Parekh); U.S. Pat. No. 3,897,037 (Johnson et al.); U.S. Pat. No. 4,036,465; U.S. Pat. No. 3,952,989 (Bannister Hatcher); U.S. Pat. No. 3,937,435 (Roberts); U.S. Pat. No. 3,762,675 (Sankey); U.S. Pat. No. 3,813,075 (Capper); U.S. Pat. No. 3,813,074 (Mulvaney); U.S. Pat. No. 4,588,074 (Strong et al.); and U.S. Pat. No. 4,064,580 (Ezekoye).

While the aforementioned structures and configurations have suggested a myriad of ways of providing book stands which are portable, and in some instances collapsible for storage purposes, there continues to be a need for a book stand which is at once inexpensive to manufacture, easy to assemble and use, and is sufficiently lightweight so as to be readily portable. Furthermore, there continues to be need for a book stand which is readily collapsible and or foldable into a configuration which is suitable for ease of storage, i.e. requiring a minimum of storage space for its maintenance.

SUMMARY OF THE INvENTION

The book shelf of the instant invention is formed of single-ply, semi-rigid material such as cardboard which is shaped generally in a substantially rectangular planar configuration. One end of that rectangular configuration has a generally isosceles triangular portion removed therefrom, thereby forming a generally triangular shaped notch on an end of the rectangular panel. The single ply of material is generally planar and defines a front surface and rear surface. Two linear crease lines are positioned to extend generally transverse of the longitudinal axis of the panel. These crease lines extend between the opposing elongate sides of the rectangular panel. The first of the crease lines is positioned proximate the side defining the width of rectangular panel and is positioned generally parallel to that side, a sufficient distance from that side to define a shelf of sufficient width to support a book having a similar width.

A second crease line is positioned parallel to the first crease line and is spacedly positioned a distance therefrom which approximates the desired elevational height to which the book is to be supported above the underlying support surface on which the book stand is to be positioned. Within the region, bordered by the two aforedescribed crease lines, two tabs may be defined. The tabs are formed by a plurality of cut lines, one interconnected to the other proximate their endpoints which define a generally three-sided configuration. A fold line extends between the cut lines whereby the fold line in association with the cut lines totally circumscribe the area of the tab.

The two tabs are spacedly positioned apart from one another. The tabs formed by the cut lines and associated fold lines are adapted to be urged outwardly so as to extend generally perpendicular to the plane of the material surface along a respective fold line which is generally oriented parallel to the longitudinal axis of the material sheet.

A third crease line which is oriented generally parallel to the first and second crease lines is spacedly positioned from the second crease line along the length of the material sheet and similar to the first and second crease lines extends from one side of the material sheet to the opposing side. In the region defined between the second and third crease lines a plurality of secondary tabs may be defined. Each of these tabs may be formed by the intersection of a plurality of cut lines interconnecting one with another to form a section which may be folded along a respective fold line and urged outwardly from the plane of the sheet along the fold line which is oriented generally perpendicular to the longitudinal axis of the material sheet. Each of these secondary tabs are adapted to engage and otherwise support the first tab members when those first tab members are positioned to extend outwardly from the material sheet. In one construction, these secondary tabs each extend through a respective opening in the planar sheet to engage its respective first tab structure.

Between the third crease line and the notch-shaped end of the material sheet two generally linear cut lines may extend from a location somewhat removed from the longitudinal edge of the sheet. These linear cut lines extend at an acute angle to the crease line toward the longitudinal axis of the material sheet. When viewed in plan view the two angulated cut lines intersect one another on the longitudinal axis of the material sheet. In conjunction with the third crease line, the two linear cut lines substantially define an isosceles configured triangle. A fold line which is spacedly removed from the longitudinal edge of the material sheet and oriented parallel thereto intersects a respective linear cut line at its endpoint and extends longitudinally along the length of the material sheet to the notch defining end of that material sheet. The triangular section defined by each linear cut line, its respective fold line and the free edge or end of the material sheet forms a third tab member. Each third tab member defines a plurality of cut lines therein each intersecting one another and, in association with a fold line, forms a tab which is extendible outwardly from the plane of the sheet material along the fold line. The fold line is oriented parallel to the longitudinal axis of the material sheet. In an assembled condition, the planar sheet is folded along its three respective crease lines. The region defined between the first and second crease line is folded so as to bring the front surfaces of the region defined between the second and third crease lines into abutment against the front surface defined between the first and second crease lines. The abutting regions are adhesively bonded to one another. The two connected regions form a generally planar member with the remainder of the region defined between the second and third crease lines extending outwardly from that plane in a generally parallel orientation. The region defined between the edge and the first crease line is folded so as to extend outwardly generally orthogonally from that first plane defined by the region between the second and third crease lines. The first set of tabs which are defined within the second region, i.e. that region between the first and second crease lines, are folded outwardly to extend approximately orthogonally from the plane of the third region, i.e., that region between the second and third crease lines. The top edge of each of those respective first tabs engages against the rear surface of the first planar region and thereby forms a support for that region to retain it in a generally orthogonal orientation, vis-a-vis second planar region. The second set of tabs which are defined within the third region are also extended outward through the openings defined when the first tabs are extended outwardly to engage against the first set of tabs and hold those tabs in their outwardly extending orientation.

The fourth planar region, i.e., that region defined between the third crease line and the notched edge of the planar sheet, is folded such that the rear surface of the fourth planar panel is abutted against the rear surface of the third planar region. These two planar panels are adhesively secured one to another with the exception of the triangular shaped tab sections previously described. Those triangular sections are extended outwardly along by folding along their respective crease lines such that they extend orthogonally outward from the plane of the fourth planar region. Each of the tabs defined within a respective triangular region is folded outwardly from its respective triangular tab panel whereby one edge of each of the tabs abuts against the back surface of the third planar panel, thereby forming a support or brace to support the triangular tab panel in its outwardly extended orientation.

Each of the triangular panels thereby forms a triangular cross section support brace which may be positioned on an underlying support surface such as a table top and thereby supporting the total book stand in an orientation wherein the third planar region is positioned at an angle to the underlying surface of sufficient degree or measure that a book may be positioned on the first planar panel and be held against the third planar panel by the orientation that first panel vis-a-vis the third panel.

The first planar region or shelf may define a plurality of slot-like apertures therein dimensioned to individually receive an "L"-shaped support member. This member is adapted so as to be insertable into a respective slot and thereafter orient an elongate member to extend upwardly from the first planar panel and engage against an open book to retain that book positioned on the third planar panel and between that panel and the upwardly extending member.

Subsequent to use the book stand of the invention is adapted whereby the first, second and third sets of tabs may individually be disengaged and returned into a generally coplanar orientation with the respective planar panels from which they were extended and are defined. Upon the tabs being returned to their coplanar orientation, the shelf formed by the first planar panel may likewise be reoriented into a orientation generally coplanar with the third planar panel. Likewise the triangular shaped supports may also be returned to a generally coplanar orientation with the fourth planar panel thereby achieving a configuration where each of the planar panels, i.e., the first, second, third and fourth planar panels are positioned adjacent one another in a parallel orientation, thereby achieving a planar panel having a nominal width and a generally overall minimal spatial requirement for storage purposes.

DETAILED DESCRIPTION OF THE INVENTION

Figure 1:
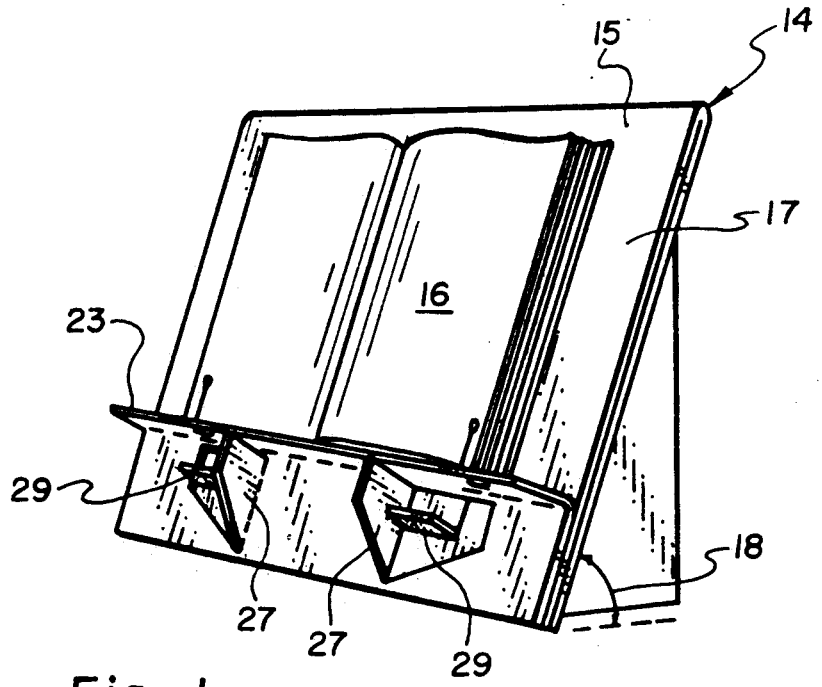
FIG. 1 is a perspective view of a book stand of the invention showing the first pair of shelf support tabs in their outwardly extending orientation.

As shown to advantage in FIG. 1, the book stand of the invention generally 14 includes a support surface 15 configured to support a book 16 at an angle 18 to an underlying surface. The support surface 17 is associated with a laterally extending shelf 23 which is positioned to extend generally orthogonally from the support surface 17 so as to form a shelf or abutment surface in which the book 16 may rest. The shelf 23 is supported in its laterally extending position by two tab-like support members 27 which extend outwardly from the plane of the support surface 17 generally orthogonally to that support surface. Each of the support tabs 27 are in turn supported by a respective secondary tab identified generally as 29. Support surface 17 is supported on a underlying surface by two laterally extending, triangularly configured wing-like members 25 which extend outwardly from the rear surface of the book stand. Each of the supporting wings 25 are in turn supported or retained in their outwardly extending positions by a respective tab support 31.

Figure 3:
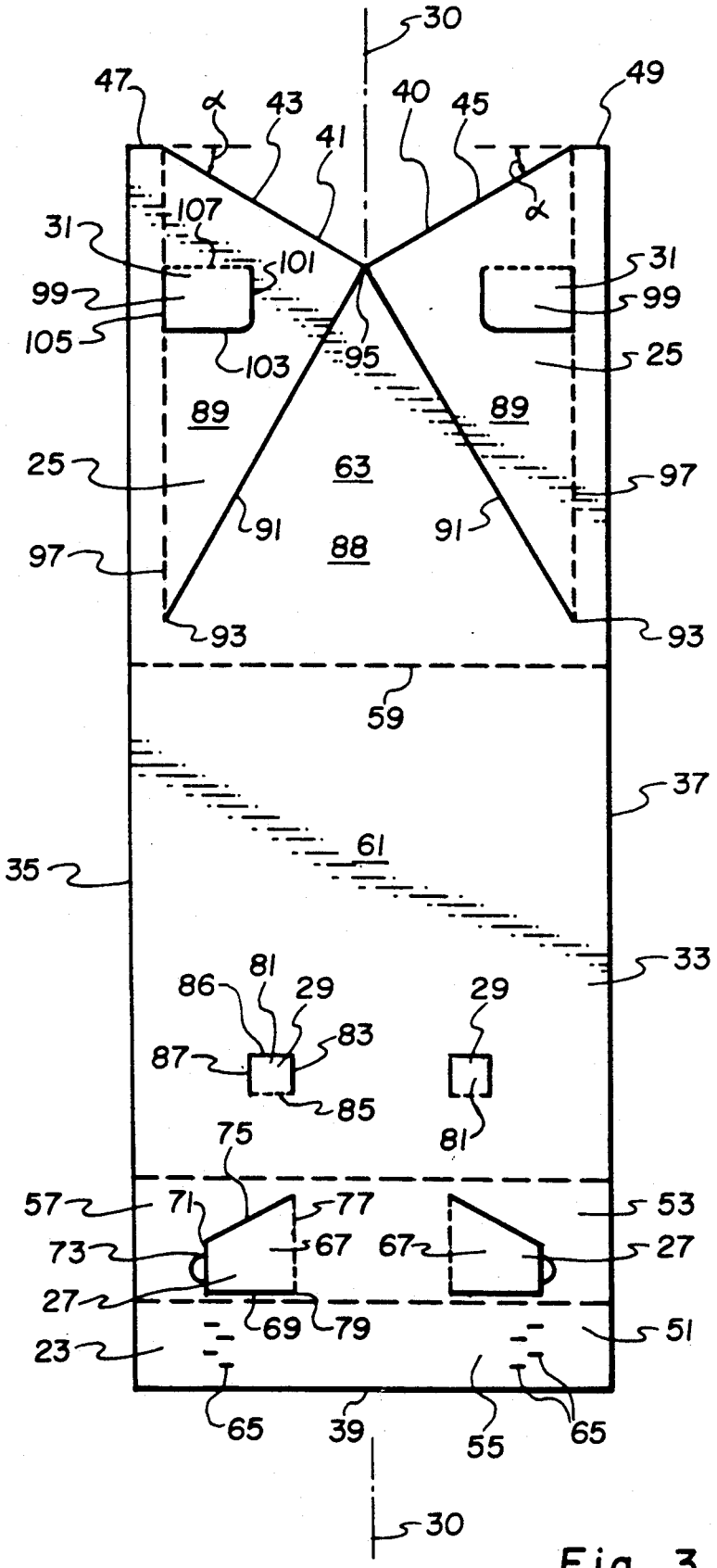
FIG. 3 is a plan view of a planar sheet from which the book stand of the invention is constructed.

The construction of this book stand may be better understood by resorting to FIG. 3. The book stand of the present invention is constructed from a single ply of semi- or substantially rigid material 33 such as cardboard. As shown in FIG. 3, this planar sheet 33 of material is out into a generally rectangular shape. The sheet of material defines two linear longitudinal sides 35 and 37. The width of the rectangular member extends between the opposing longitudinal sides 35 and 37. The lateral sides or width of the panel 33 includes a linear side 39 and an opposite side 40 which is not linear in configuration. As shown, side 40 is formed by a pair of short linear segments generally 47 and 49, which extend from each of the longitudinal sides 35 and 37, parallel to one another and collinear with one another. At a location slightly removed from the longitudinal edges 35 and 37, the linear segments 47 and 49 connect into a respective linear side 43 and 45 which is oriented at an angle alpha to the sides 47 and 49. Each of the sides 43 and 45 intersect one another proximate their joint intersection with the longitudinal axis 30 of the elongate sheet 33. When viewed in plan view the side 40 defines a generally notch-shaped end with the exception of the substantially linear side segments defined by the sides 47 and 49. The sheet 33 defines a front planar surface and a rear planar surface.

FIG. 3 illustrates the front planar surface. It is to be understood that the rear planar surface is basically a mirror reflection of the front planar surface. The sheet 33 defines a first linear crease line 51 which is positioned spacedly from the side 39 and extends generally orthogonal to the longitudinal axis 30 of sheet 33 and parallel to the side 39. Crease line 51 is adapted to facilitate the bending of the planar sheet 33. The crease line 51 in association with the longitudinal sides 35 and 37 defines a generally rectangular shaped planar region 55.

A second crease 53 which is also linear in configuration is oriented parallel to crease line 51 and side 39. Second crease line 53 is oriented perpendicular to longitudinal axis 30 and is spacedly positioned from crease line 51. Second crease line 53, in association with crease line 51 and longitudinal sides 35 and 37, forms a substantially planar, rectangular configured planar region 57.

A third crease line 59 having a linear configuration is oriented parallel to crease lines 53 and 51. Crease line 59 in association with crease line 53 and longitudinal sides 35 and 37 defines a third planar region generally 61. Crease line 59, in association with end side end edges 41 and 45, and further in association with longitudinal sides 35 and 37, defines a fourth planar region 63.

Returning to the first planar region 55 as shown in FIG. 3, this planar region defines a plurality of linear or elongate slots 65 which pass through the entire thickness of the sheet 33 and hence through the entire thickness of the planar region or section 55. Alternatively, slots 65 may pass partially through that thickness. Slots 65 are segregated into two definable groupings, a first grouping which is positioned to the right of the longitudinal axis 30 and a second grouping which is positioned to the left of that longitudinal axis. The slots 65 are oriented in a generally offset arrangement.

Figure 2:
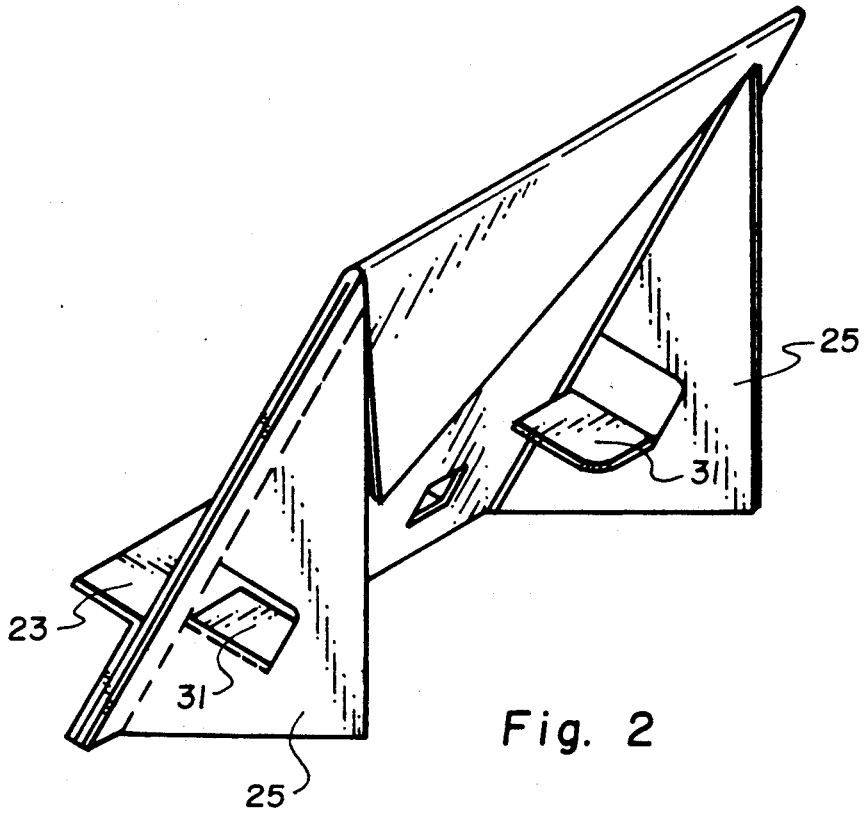
FIG. 2 is a back view of the book stand shown in FIG. 1 wherein the triangular shaped support panels are shown with their respective third tabs in an outwardly extending orientation.

In the second planar region 57 two generally quadrilaterally configured tab members 67 are spacedly defined. Each tab member 67 is formed by a first cut line 69 which is positioned spacedly from the crease line 51 and extends parallel to that crease line. As shown in FIG. 3, a narrow border or panel extends between the crease line 51 and the cut line 69. The border permits the shelf 23 to rest atop of each of the supports 27. A second cut line 71 interconnects with the first cut line 69 proximate its endpoint and extends parallel to longitudinal axis 30 a measured distance from the crease line 51. The third cut line 75 extends from the endpoint 71 and extends from the cut line 71 towards the longitudinal axis 30 at an obtuse angle to cut line 71. Cut line 75 ends at a point which is collinear with the endpoint of cut line 69 along a line which is parallel to the longitudinal axis 30. The collinear line from which the endpoints of cut line 69 and 75 are defined is formed into a fold line 77. Understandably, all of the cut lines 69, 71 and 75 extend through the complete thickness of the planar sheet 33. A generally semi-circular cutout 73 is defined within the planar sheet 33 contiguous to cut line 71 thereby providing the user with a means of inserting his finger or another object therethrough and engaging the rear surface of the tab 67 and thereafter urging that tab outwardly by folding it along fold line 77. Each of the tabs 67 are spaced apart from one another sufficiently so as to provide a balanced and stable support for the shelf 23 of the book stand. The spacing between cut lines 69 and crease line 51 is adapted whereby as the first planar panel 55 is folded along that crease line 51 to form shelf 23, the top surface of the tab panel 67 which is formed by the cut line 69 readily engages the planar panel 55 in an orientation whereby that planar panel 55 is oriented orthogonal to the planar panel 57. Spacedly defined in planar panel 61 are two tabs 81. The tabs 81 are each defined by a first cut line 83 which extends parallel to longitudinal axis 30. Each first cut line 83 intersects at its first endpoint with a second cut line 86 which extends perpendicular to the longitudinal axis 30. A third cut line 87 extends parallel to longitudinal axis 30 and intersects at its first endpoint the fold line 85. The second endpoint of cut line 87 is oriented at a location which is collinear with the endpoint of cut line 83. The endpoints of cut line 87 and 83 are collinear with a fold line 85 which extends therebetween. The tab 81 is urged outwardly away from planar surface 61 by folding the tab along fold line 85 such that it extends outwardly therefrom. Each of the tabs 81 are positioned in planar panel 61 such that in the assembled configuration of the book stand each tab is oriented to engage and otherwise abut against a respective tab 67 thereby holding that tab 67 in an outwardly extending orientation. Tabs 81 correspond to or are identical to tabs 29 shown in FIG. 1. Likewise, tabs 67 correspond with tabs 27 shown in FIG. 1. In planar panel 63 a pair of cut lines 91 extend from the intersection of the sides 43 and 45 outwardly towards the respective longitudinal side 35 and 37. Each of the cut lines 91 has an endpoint which is spacedly removed from its respective longitudinal side, thereby forming a border therebetween. That border, which has the width of the corresponding end section 47 and 49, maintains a constant width along the planar section 63. A fold line 97 extends along that border and intersects at its first endpoint with the end side edge 47 or 49 and intersects on its opposite endpoint with the endpoint of cut line 91, shown designated at point 93. Fold line 97 is oriented parallel to longitudinal axis 30. Fold line 97, in association with cut line 91 and edge 41 or, in the alternative, fold line 97, cut line 91 and edge 45, each respectively define a triangular shaped tab. This tab is adapted to be extended outwardly from the plane of the fourth planar panel 63 by folding that panel along fold line 97. Defined within each triangular tab 89 is a tab member 99. As shown, each tab member 99 is defined by a cut line 101 oriented parallel to longitudinal axis 30, a second cut line 103 oriented perpendicular to longitudinal axis 30 and intersecting cut line 101 at its endpoint, and a third cut line 105 which is shown to be collinear with fold line 97 i.e., parallel to axis 30. Cut line 105 intersects at its endpoint the second cut line 103. The other opposing endpoint of cut line 105 and the endpoint of cut line 101 are connected therebetween by a fold line 107 which is oriented perpendicular to longitudinal axis 30. The fold lines 107 of each of the corresponding tabs 99 are oriented collinear one with another as are fold lines 85 of each of the two tabs 81. The tabs 99 are adapted to be urged outwardly to extend laterally from each of the tabs 89 and engage against the back surface of the book stand thereby forming a support for each of the tabs 89 and retaining them in an outwardly extending position. As shown in FIGS. 1 and 2, tabs 89 correspond to the support members 25 whereas tabs 99 correspond generally with tabs 31.

Figure 5:
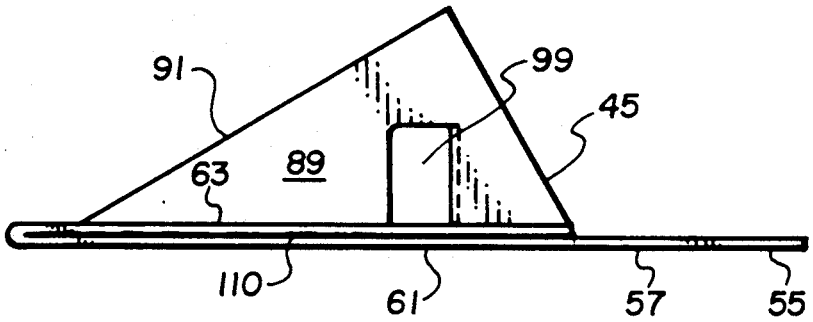
FIG. 5 is a side view of the partially constructed book stand shown in FIG. 4.
Figure 4:
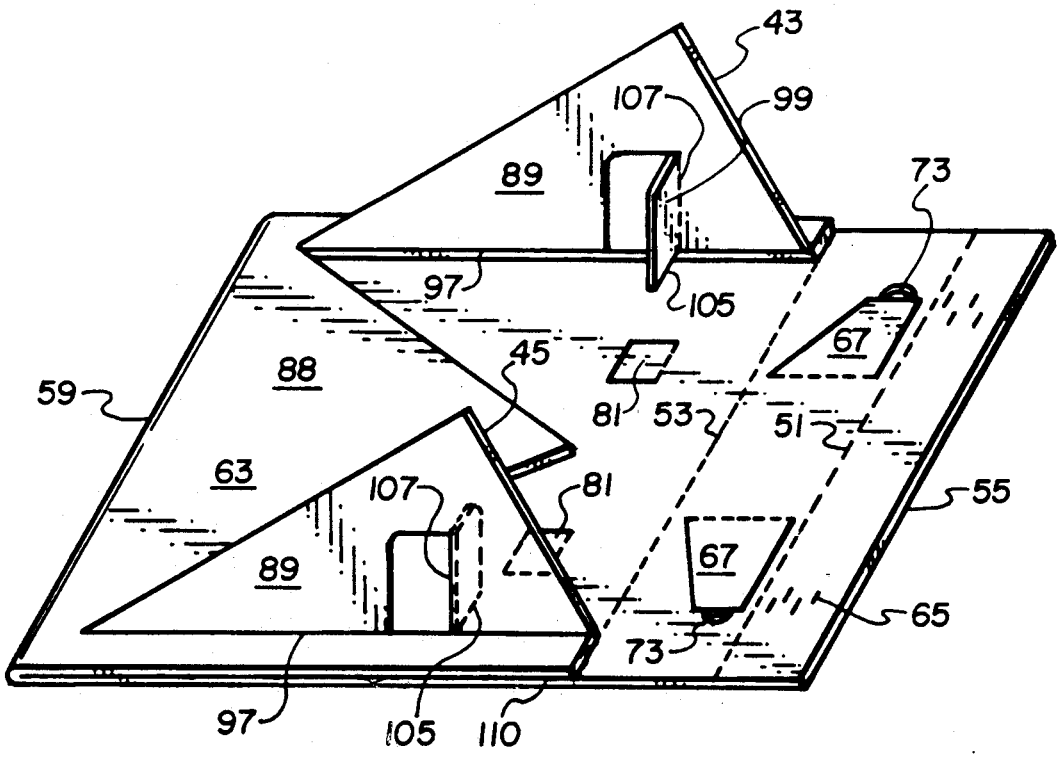
FIG. 4 is a view of a partially constructed book stand wherein the fourth and third planar panels have been adhered one to another.

FIGS. 4 through 9 illustrate a step-by-step construction of the book stand from the already stamped and cut planar panel 33 as shown in FIG. 3. As shown in FIGS. 4 and 5, the planar panel 33 has been folded along crease line 59 thereby bringing the back surfaces of planar panels 63 and 61 into abutment one against another. As shown, glue 110 has been applied between the abutting back surfaces thereby adhering those two surfaces together. The tabs 89 have been folded along their respective fold lines 97 such that they extend outwardly, generally orthogonally to the planar surface of panel 63. The tabs 99 likewise have been folded outward along their respective fold lines 107 to bring them into an orientation which is generally orthogonal to the plane of their respective tabs 89. In this configuration the edge of each of the tabs 99 defined by the respective cut lines 105 engage against the back surface of planar surface 61 thereby forming a generally rigid support structure for their respective tabs 89.

Figure 6:
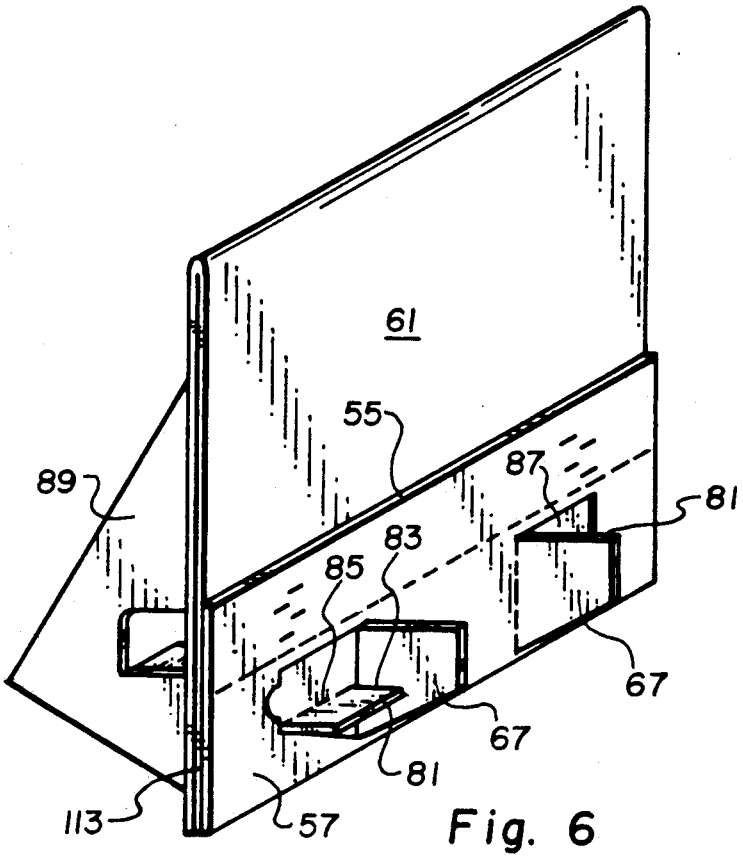
FIG. 6 is a perspective view of a partially constructed book stand wherein the second, third and fourth planar panels have been adhered one to another and the first and second pair of tabs have been positioned in their outwardly extending orientation.

As shown, tabs 99 effect an orientation of each of the respective tabs 89 in an orthogonal orientation to the planar surfaces 61 and 63 and retain those tabs 89 in that orientation. The edges 43 and 45 of the tabs 89 form the engaging edges of the support defined by the respective tabs 89. FIG. 6 shows the second stage of construction wherein the planar sheet 33 has now been folded along its crease line 53, thereby bringing the front surfaces of planar panels 61 and 57 into abutment. As shown, glue 113 has been applied on the interface of these two front surfaces to adhere or bond them one to another. Tabs 81 have been folded along their respective fold lines 85 to bring them outwardly into an orientation which is generally orthogonal to their planar surfaces 61. Furthermore, each of the tabs 67 has likewise been folded along their respective fold lines 77 into an orientation which is generally orthogonal to their respective planar panel surface. As shown, the edge 83 of the first tab 81 and the edge 87 of the second tab 81 engage against the planar surface of the respective tab 67. This engagement forms a supporting member or brace against for tab 67, thereby retaining tab 67 in its outwardly extending orientation, orthogonal to the plane of panel 57.

Figure 7:
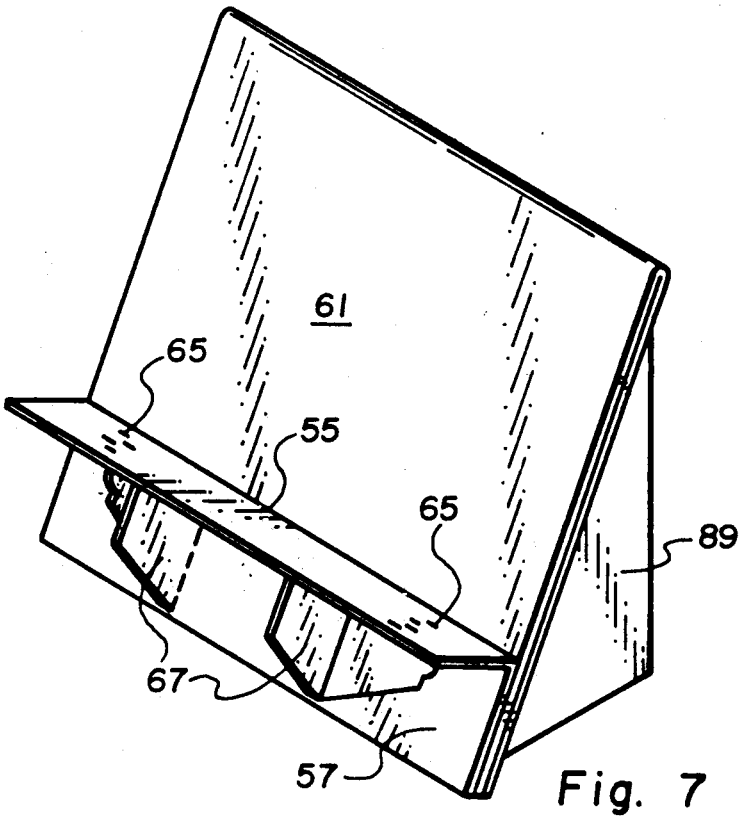
FIG. 7 is a perspective view of a completed book stand configuration wherein the first set of outwardly extending tabs are shown in their operative orientation.

As shown in FIG. 7 the first planar sheet 33 has been folded along crease line 51 thereby orienting panel 55 generally orthogonally to the plane of panels 57 and 61. This construction forms the shelf 23 previously described in FIGS. 1 and 2. The planar section 55 engages against the topmost edges of the tabs 67 and is supported thereon so as to form a shelf having sufficient stability and integrity for a book which may thereafter be positioned thereupon. As shown, the slots 65 are spacedly positioned sufficiently from the bracket support tab 67 such that the user may insert therethrough a plurality of support members 111 (FIGS. 10 and 11).

Figure 9:
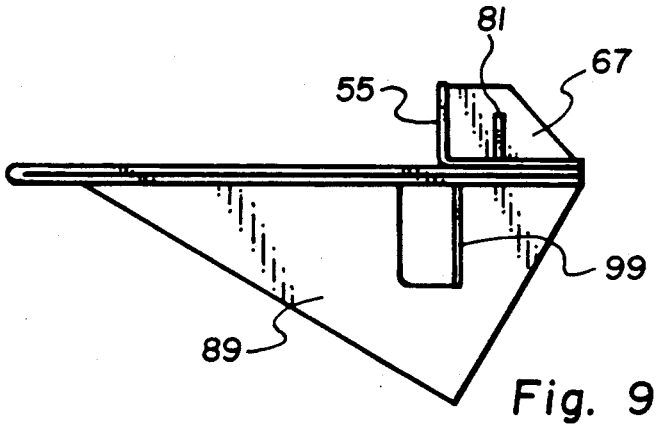
FIG. 9 is a side view of the book stand of FIG. 8.
Figure 8:
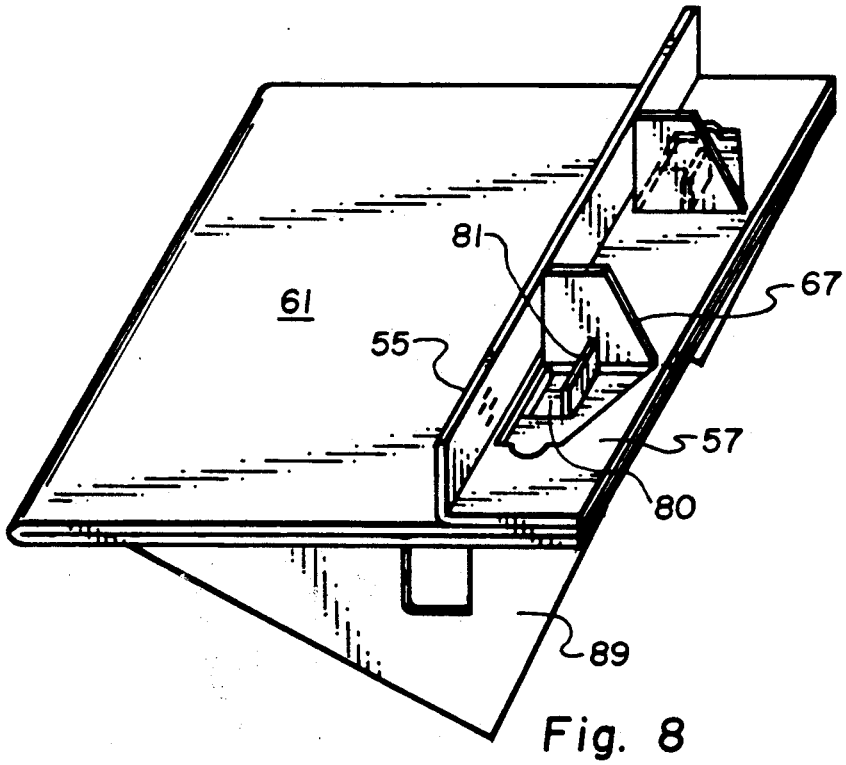
FIG. 8 is a perspective view of a book stand of the invention wherein the second set of tabs are shown in their first tab supporting orientation.

FIGS. 8 and 9 show the book shelf in a tilted back orientation whereby the viewer may see interaction of the tabs 67 with the shelf 23 formed by planar section 55. As shown, each of the tabs 81 extend outwardly from their respective planar surfaces 61 through an aperture 80 defined by the outwardly extended positioning of a respective tab 67 and engage against the planar panel 67, thereby holding that panel in a fixed orientation generally orthogonal to the plane of the supportive planar surface 57.

Figure 11:
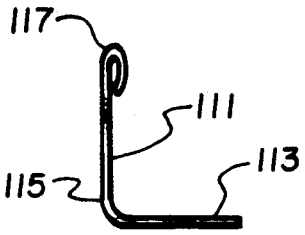
FIG. 11 is a side view of a support member adapted for use with the shelf of the instant invention.
Figure 10:
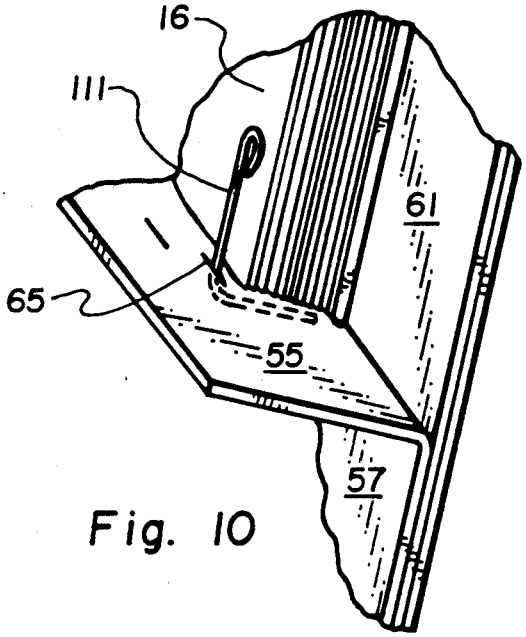
FIG. 10 is a partial perspective view of the shelf, i.e., the first planar panel of the invention showing a book support member installed within an aperture defined within the shelf member.

FIGS. 10 and 11 illustrate the placement of the support members 111 in a respective aperture 65 defined within planar panel 55 which defines shelf 23. As shown, each of the support members is generally an "L"-shaped member having a elongate linear leg 113 conjoined as its endpoint with a vertically extending leg 115. Understandably, support members of other configurations may also be used. Mounted atop the leg 115 is a head 117 which is adapted to engage against a book 16 mounted on shelf 23. Support members may be fabricated from any substantially rigid material such as metal or plastic. The height of leg 115 is adapted so as to provide sufficient engagement against the pages of the book to retain those pages in a fixed relationship vis-a-vis the shelf 23 and the underlying support 61.

Figure 12:
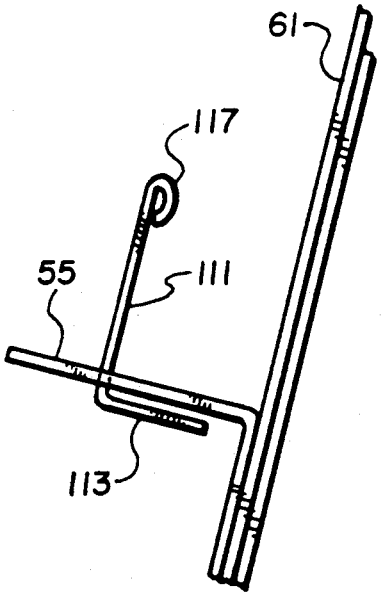
FIG. 12 is a side view of a shelf of the invention.

As shown in FIG. 12, the support members 111 may be mounted so as to extend completely through the panel of shelf 55. In this construction, the configuration of the slots in the shelf are dimensioned to be slightly smaller than the support member. Further, the shelf is fabricated of a material having some resilience, e.g., cardboard, whereby after the support member is inserted, the material about the slot opening tends to be urged into abutment against the support member so as to retain that member in place.

Figure 13:
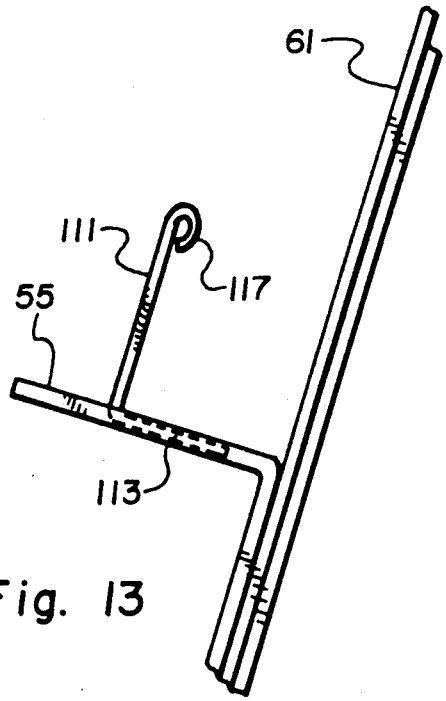
FIG. 13 is a side view of a shelf of the invention illustrating an alternative installation of a support member.

Alternatively, as shown in FIG. 13, the shelf 55 may be formed of a material which is sufficiently soft that the user may insert leg 113 into the body of the shelf 55 itself. Similar to the before-described embodiment, the resilience of the material making up the shelf 55 retains the support 111 in position.

It is to be understood that the instantly described embodiment is intended solely as a description of a preferred embodiment. Those skilled in the art will recognize that the embodiments herein discussed are illustrative of the general principles of the invention. The embodiments herein described are not intended to limit the scope of the claims which themselves recite what applicant regards as his invention.

What is claimed:

1. A book holding device comprising:

an elongate planar panel having a front and rear surface, and a shelf formed on said panel, said panel defining a longitudinally oriented fold line therein and a first plurality of cut lines, said first fold line and said first plurality of cut lines circumscribing a first region of said panel and defining a first support tab; said first region defining a second fold line and a second plurality of cut lines which jointly circumscribe a second region and define a first auxiliary tab; said first support tab being positionable to extend outwardly from said panel along said first fold line, said first auxiliary tab being positionable to extend outwardly from said first support tab along said second fold line, thereby engaging said rear surface of said panel to retain said first support tab in substantially fixed spatial relationship with said rear surface.

2. The book holding device of claim 1 wherein said panel defines two of said first support tabs each having a respective said first auxiliary tab associated therewith, said two first support tabs being spacedly positioned from one another.

3. The book holding device of claim 1 wherein said shelf is formed by folding said panel along a creased line proximate an edge of said panel to form an outwardly extending member.

4. The book holding device of claim 1 wherein said panel defines a second support tab formed by a third fold line in association with a third plurality of cut lines, said second support tab being positioned to extend outwardly from said planar panel, said second support tab being positionable to engage and support said shelf.

5. The book holding device of claim 4 wherein said panel further defines a second auxiliary tab formed of a fourth fold line and a fourth plurality of cut lines, said second auxiliary tab being positionable to extend outwardly from said panel and engage said second support tab and retain that tab in a substantially spatial relationship with said panel.

6. The book holding device of claim 5 wherein said device includes two said second support tabs, each second support tab having associated therewith a respective said second auxiliary tab.

7. The book holding device of claim 4 wherein said device includes two said second support tabs positioned spacedly apart from one another.

8. The book holding device of claim 5 wherein said second auxiliary tab in its extended orientation passes through an opening defined within said panel by said extended positioning of said second support tab.

9. The book holding device of claim 1 wherein said panel front surface is folded back on itself to form a reinforced region positioned contiguous said shelf.

10. The book holding device of claim 9 wherein said panel is bonded to itself along said folded back front surface defined reinforced region.

11. A book holding device comprising:

a substantially rigid planar panel having a front surface and rear surface, said panel being folded along a first fold line to form an outwardly extending shelf, said panel defining a first support member formed by an association of a second fold line and a plurality of cut lines, said first support member being positionable to extend outwardly from said panel and engage said shelf to provide a supporting brace therefore, said panel further defining an auxiliary support tab formed by an association of a third fold line and a second plurality of cut lines, said auxiliary support tab being positionable to extend outwardly from said panel and engage said first support member and retain said first support member in a fixed relationship to said shelf.

12. The book holding device of claim 11 wherein said device includes a pair of said first support members spacedly positioned apart from each other.

13. The book holding device of claim 12 wherein each said first support member is associated with a respective said auxiliary support tab.

14. The book holding device of claim 11 wherein said auxiliary support tab extends through an opening defined within said panel by the extension of its respective first support member from said panel.

15. The book holding device of claim 11 further including a second support member defined by an association of a fourth fold line and a third plurality of cut lines, said second support member being extendable from said panel to form an engagement with an underlying support for retaining said panel in an upright orientation.

16. The book holding device of claim 15 wherein said second support member defines a second auxiliary support tab formed by an association of a fifth fold line and a fourth plurality of cut lines, said second auxiliary support tab being positionable to extend outwardly from said second support member and engage said rear surface of said panel wherein said second auxiliary tab retains said second support member in a fixed spacial relationship to said rear surface.

17. The book holding device of claim 11 wherein said panel is folded back on itself to form a reinforced region proximate said shelf.

18. A book holding device comprising:

a planar panel;

a support means mounted on said planar panel for supporting said panel in an upright orientation;

a shelf means formed on said panel for retaining a book thereon, said shelf defining a plurality of spectrums therein, and at least one retainer, each retainer being manually insertable and retractable from said spectrums, each retainer being positionable to contact a book retained on said shelf and retain said book on said shelf.

19. The book holding device of claim 18 wherein said retainer is insertable into said shelf to be positionable within the body of said shelf between an upper surface and a lower surface thereof.

* * * * *